US007351118B1

(12) United States Patent
Duesterhoeft et al.

(10) Patent No.: US 7,351,118 B1
(45) Date of Patent: Apr. 1, 2008

(54) POKE-IN CONTACTS FOR MODULAR PCB ASSEMBLY

(75) Inventors: Scott Stephen Duesterhoeft, Etters, PA (US); Christopher George Daily, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/550,148

(22) Filed: Oct. 17, 2006

(51) Int. Cl.
*H01R 13/432* (2006.01)

(52) U.S. Cl. ..... 439/748; 439/607

(58) Field of Classification Search ..... 439/748, 439/839, 833, 843, 838, 842, 844–846, 850, 439/862, 676, 607–610, 701, 852
See application file for complete search history.

(56) References Cited

U.S. PATENT DOCUMENTS 4,422,128 A 12/1983 Zurlinden et al.
5,424,918 A 6/1995 Felps et al.
5,711,687 A 1/1998 Kuiper-Moore et al.
6,062,918 A * 5/2000 Myer et al. ..... 439/839
6,461,200 B1 * 10/2002 Shi et al. ..... 439/676
6,464,547 B2 10/2002 Ketelsleger
6,629,865 B2 * 10/2003 Bungo ..... 439/852
6,926,541 B2 8/2005 Takeuchi et al.
7,046,516 B2 5/2006 Lee et al.
2004/0115990 A1 * 6/2004 Kodama ..... 439/607

* cited by examiner

*Primary Examiner*—Edwin A. Leon

(57) ABSTRACT

A poke-in contact modular assembly for a printed circuit board that has a solderless connection with a junction box. The assembly allows for easier and more efficient removal and replacement of the printed circuit board and electrical components. In addition, the poke-in contact is configured to reduce the amount of normal force applied to the printed circuit board when wire tabbing is inserted into the contacts.

12 Claims, 4 Drawing Sheets

POKE-IN CONTACTS FOR MODULAR PCB ASSEMBLY

BACKGROUND OF THE INVENTION

The present invention is directed to an improved system and method for securing electronics in a junction box. More specifically, the present invention is directed to a contact assembly for securing electronics in a junction box without the use of tools or other equipment.

Most commonly, current systems use fragile electronics disposed in the junction boxes. The electronic components are unable to sustain the forces of inserting wire tabbing into the connections within the junction box. Often times the electronics are damaged or the solder connections are broken from the force of repeatedly inserting and removing the wire tabbing into the junction box. One current system redesigned the typical junction box by adding a second capsule around the body section of the entire contact body to help remedy the issue of the force when inserting the wire tabbing. The second capsule provides extra support and strength to withstand the normal force from inserting the wire tabbing into the junction box when making an electrical connection. However, this system requires more materials for manufacture, is more expensive and requires a longer assembly time.

Other current methods eliminate the second outer capsule discussed above, where the junction box is constructed of material strong enough to withstand the normal force applied during insertion of the wire tabbing. However, in order to maintain a solid connection with the wire tabbing, these systems require the aid and use of tools or equipment to initiate the connection with the wire tabbing. The use of the tools and equipment to make the connection is time consuming, as well as expensive. In addition, often times, these tool connections are permanent and prevent the replacement of any of the components.

In addition, the wire tabbing used to make electrical connections with the electronics within the junction box are connected with a solder connection which is time consuming and expensive when both designing and repairing the system.

Thus, what is needed is a system that is configured with a receptacle that is capable of receiving wire tabbing and strong enough to withstand the normal force of insertion. A system that allows for easy repairs and replacement when necessary to reduce time and costs is needed as well.

SUMMARY OF THE INVENTION

An embodiment of the present invention includes a connector assembly for receiving an electrical component having a base, and a plurality of pin tails extending in a substantially perpendicular direction away from the base. The pin tails connect to a printed circuit board. The connector assembly also has a plurality of walls extending from the base in an opposed direction of the plurality of pin tails and a top extending between the plurality of walls and substantially parallel to the base. Further, the connector assembly has a lance extending from the top having an arcuate back end, a contact beam that extends parallel to the base, a front section at a preselected angle to the contact beam and at least one protrusion extending from a side of the front section. The electrical component is manually inserted into the connector assembly with an insertion force, pressing against the front section, which moves upon insertion of the electrical component. Upon displacement, the contact beam touches the base to complete an electrically conductive connection, and the electrical component is secured in the connector until a force is applied to the at least one protrusion extending from the side of the front section.

Another embodiment of the present invention includes a poke-in contact assembly having a base, a plurality of pin tails extending in a substantially perpendicular direction away from the base and secured to a printed circuit board, a plurality of walls extending from the base in an opposed direction of the plurality of pin tails and a top extending between the plurality of walls and substantially parallel to the base. The contact assembly also has a lance disposed to extend from the top having an arcuate back end, a contact beam that extends parallel to the base and a front section disposed at a preselected angle to the contact beam, and at least one protrusion extending from a side of the front section. An electrical component is manually inserted into the connector assembly, pressing against the front section, which moves upon insertion of the electrical component, and upon displacement, the contact beam touches the base to complete an electrically conductive connection. The lance exerts an equal and opposite reactive force upon the electrical component to secure the electrical component in the connector assembly and the electrical component is secured in the connector until a force is applied to the at least one protrusion extending from the side of the front section.

One advantage of the present invention is the lower manufacturing, replacement and maintenance costs of the system.

Yet another advantage of the present invention is improved replaceability functionality.

Another advantage of the present invention is that no tools or equipment are necessary to electrically connect the wire tabbing in the poke-in contact.

Yet another advantage of the present invention is that no support apparatuses are required for the contact.

Another advantage of the present invention is high retention of the contact.

Another advantage of the present invention is that the present invention can replace the circuitry in current systems with little or substantially zero modifications to the circuitry exterior to the junction box.

Yet another advantage of the present invention is low normal force applied during insertion of the wire tabbing into the poke-in contact.

Another advantage of the present invention is the locking mechanism of the lance once the wire tabbing is inserted into the poke-in contact.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

The present invention is directed to a poke-in contact mount assembly that reduces the normal forces sustained by the circuit board and components during insertion of the wire tabbing into the junction box.

Figure 1A:
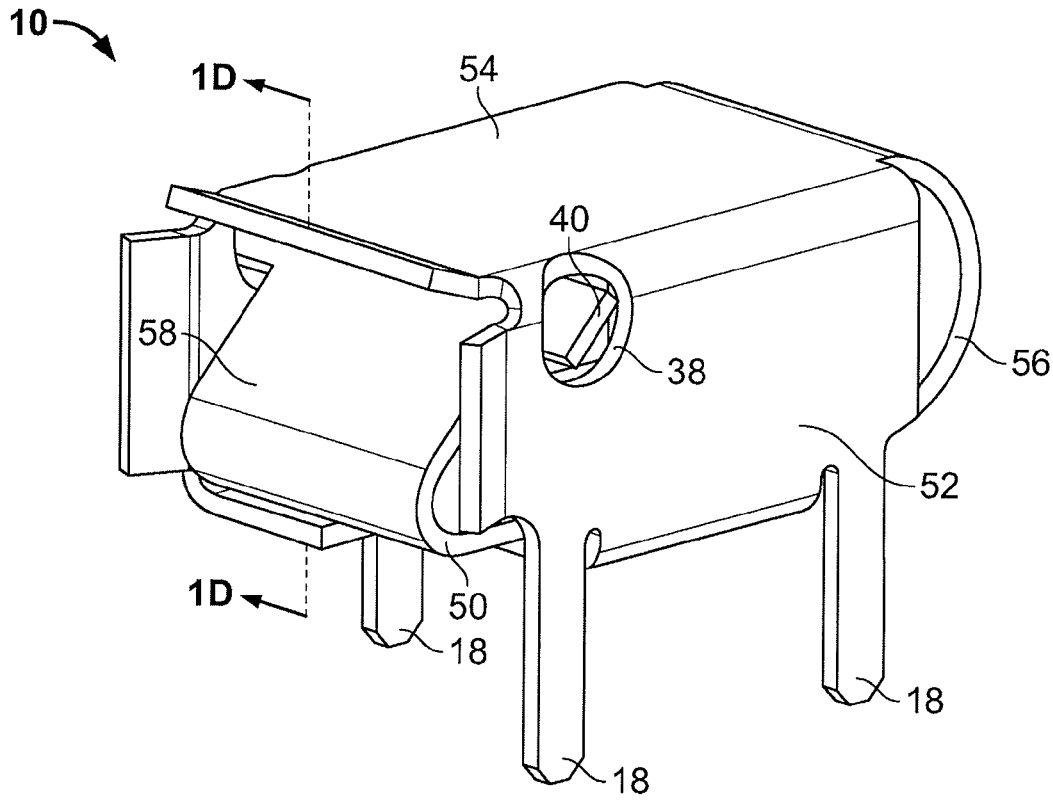
FIG. 1A illustrates a perspective view of the top of the present invention.
Figure 1B:
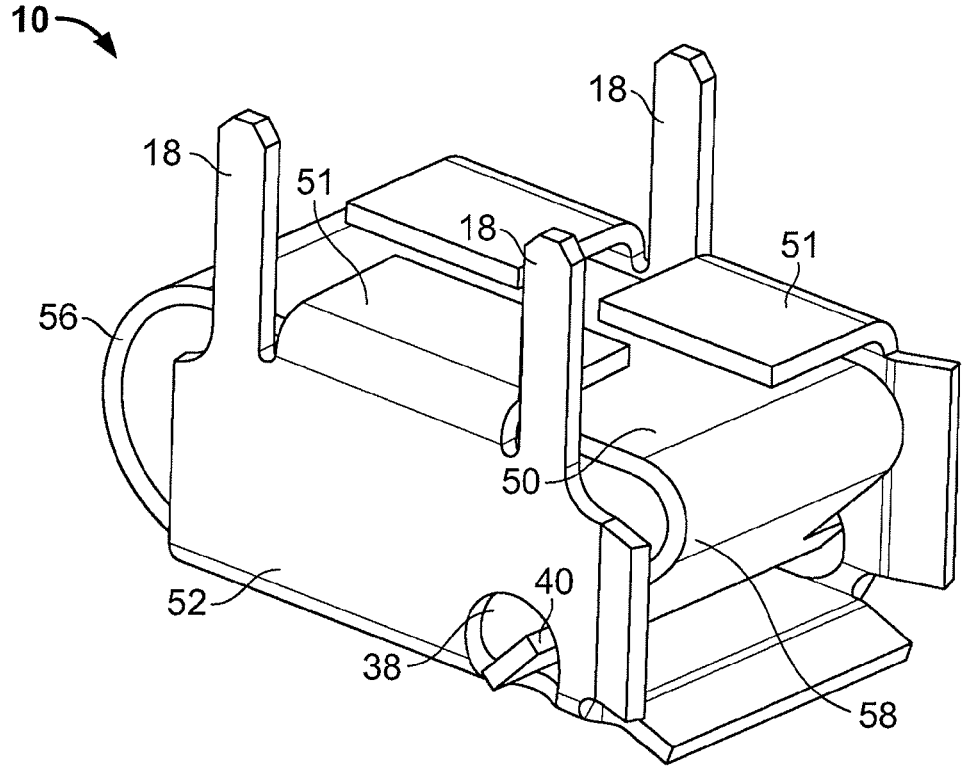
FIG. 1B illustrates a perspective view of the bottom of the present invention.

FIGS. 1A, 1B, 1C and 1D illustrate various views of the poke-in contact 10 used in the present invention. As shown in FIGS. 1A and 1B, the poke-in contact 10 includes a base section 51, with generally upstanding wall sections 52 that extend perpendicular and upward from the base 51 to form parallel opposite walls. Parallel to the base 51 and connected on the opposite end of the wall sections 52 than the base 51, a top section 54 extends and spans the distance between both wall sections 52. The base 51, wall sections 52 and top section 54 form a box-like structure, having four defined areas connecting to enclose a space. Extending from the top section 54 and wrapping around in an arcuate shape, a locking lance 30 contains three portions, a back section 56, a contact beam 50 and a front section 58. The back section 56 forms a hemi circular shape similar in cross-section to a half circle before it transitions into the contact beam 50. The contact beam 50 is adjacent to and parallel to the base 51, but not contacting the base 51. The contact beam 50 extends the entire length of the base 51 and turns upward forming a front section 58 that angles in toward the center of the poke-in contact 10. The front section 58 preferably rests at an angle of approximately forty-five degrees from the contact beam 50, but any other suitable angle may be used. The poke-in contact 10 can be constructed of copper, a copper alloy, or any other suitable material that is electrically conductive, substantially flexible to accept an insert, while being substantially sturdy and rigid to provide retention when force is applied. The alloy may be of thickness of about 0.35 mm thick, but can be constructed with any thickness suitable for the contact 10 to operate correctly with the required retention.

FIG. 1A illustrates a perspective view of the top of the poke-in contact assembly 10. On each of the wall sections 52, a wall aperture 38 is located, where a portion of the locking lance 30 protrudes. The protrusion 40 of the locking lance 30 through this wall aperture 38 provides the ability to deflect the lance 30 with a tool or utensil when necessary to remove the wire or conductive material that is secured in the poke-in contact 10. The wall apertures 38 also acts as a check device to ensure that the front section 58 of the lance 30 is not displaced to an angle that would cause damage to the lance 30.

Figure 1C:
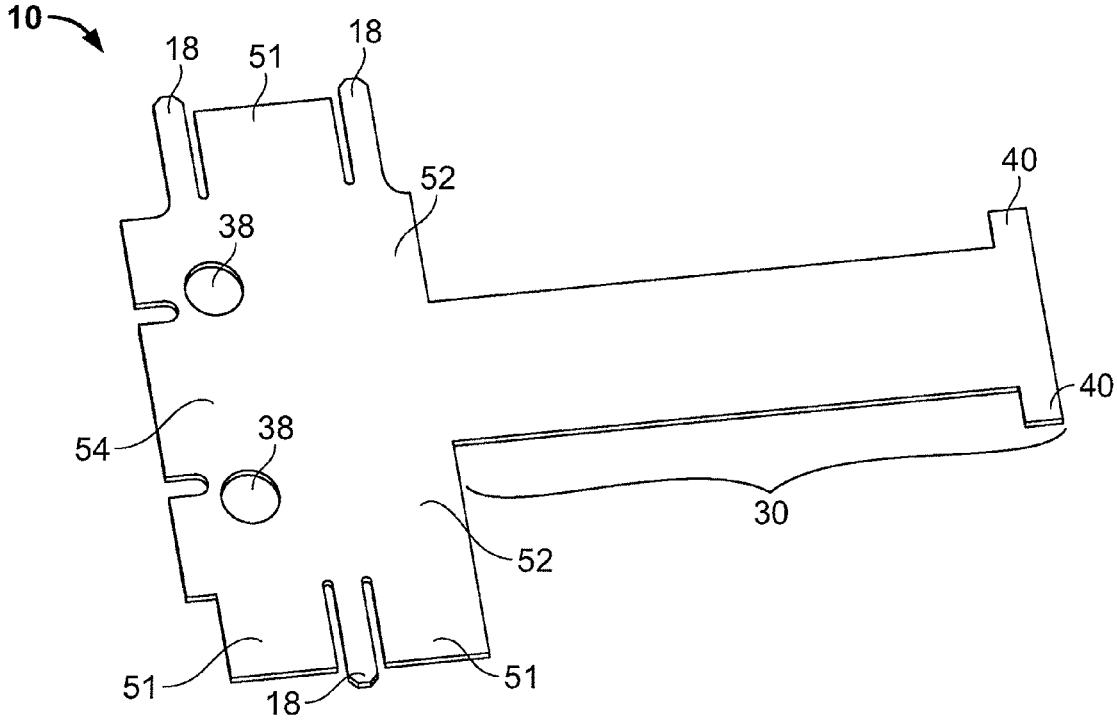
FIG. 1C illustrates a surface area view of the present invention.

FIG. 1B illustrates a perspective view of the bottom of the contact 10. The solder pin tails 18 are disposed to secure the contact 10 to the printed circuit board 12 by a solder connection or other suitable connection. FIG. 1C illustrates the surface area and shape of the present invention in an intermediate form, as the assembly is initially stamped from sheet stock. The wall apertures 38 are shown, along with the protrusions 40 on the lance 30. In addition the solder pin tails 18 are also disposed along the edges of the contact 10. FIG. 1C shows the poke-in contact 10 being of unitary construction and stamped to form the base 51, walls 52, top 54, and lance 30 of the contact 10 as depicted in FIGS. 1A and 1B. It should be known that the poke-in contact may also be manufactured and assembled from more than one unitary piece.

Figure 1D:
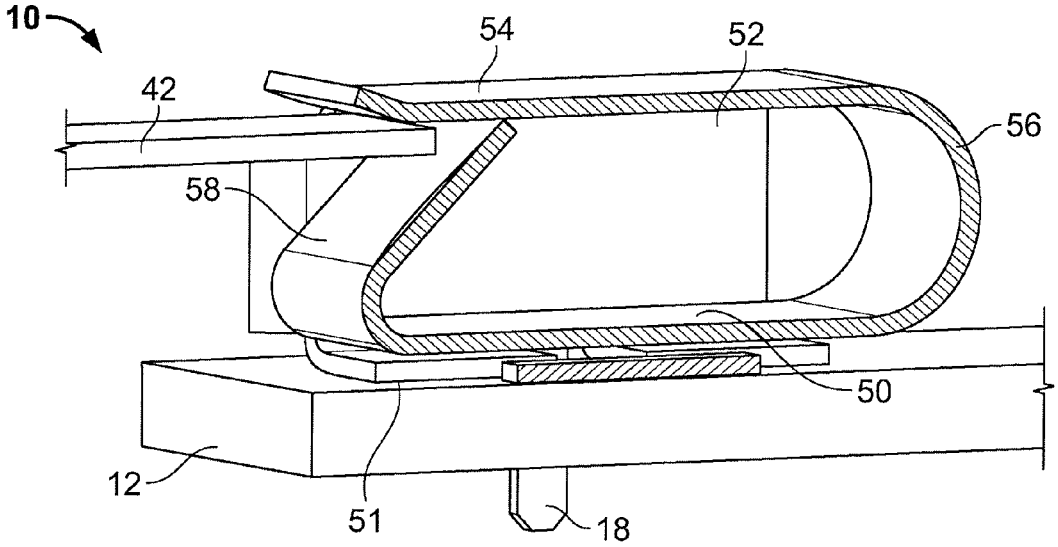
FIG. 1D illustrates a cross sectional view of the contact of the present invention.

FIG. 1D illustrates a cross sectional view of the poke-in contact 10 of FIG. 1A. The printed circuit board 12 receives the solder pin tails 18 of the contact 10, where they are secured into place by solder or other similar connection. A wire tabbing 42 enters the poke-in contact 10 by pushing against the front section 58 of the lance 30. The front section 58 of the lance 30 deflects to receive the wire tabbing 42 by displacing the contact beam 51 toward the base 28 of the contact 10 while maintaining a firm tension on the wire tabbing 42 to secure the wire tabbing 42 in place. When an opposite force is applied to the wire tabbing 42, such as a force to remove the tabbing 42 from the lance 30, the lance 30 provides a preselected range of retention, preferable ten to fifteen pounds. The force can be adjusted by angle selection, material selection, material thickness and the size of the contact 10. In effect, as resistance is created against the lance 30, the lance 30 responds with a greater force, an equal and opposite force against the tabbing, to secure the wire up to fifteen pounds of force. To easily and quickly remove the tabbing 42 from the contact, a tool such as a screwdriver, a similar device or other suitable tool can be used to contact the protrusions 40 of the lance 30, releasing the contact of the lance 30 and the tabbing 42, and allowing the tabbing 42 to retract from the contact 10. The protrusions 40 are forced away from the top 54 by the tabbing 42, creating a space between the wire tabbing 42 and the front section 58 of the lance 30 and allowing the wire tabbing 42 to be removed with no reaction force applied by the lance 30. The inserted structure is not limited to tabbing as shown and can include wire.

Figure 2:
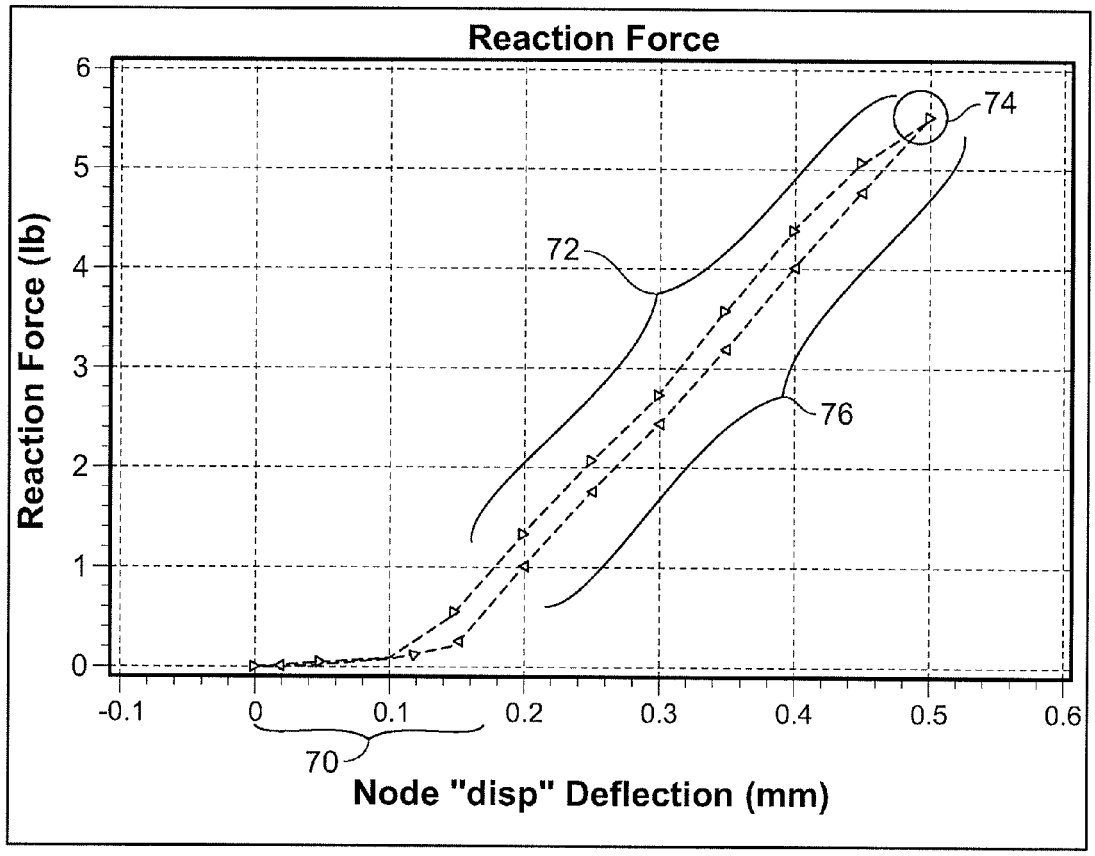
FIG. 2 is a graphical analysis of the reaction force of the poke-in contact.

FIG. 2 graphically illustrates the reaction force during displacement of the lance 30 on a wire tabbing 42 inserted into the contact 10. As shown in portion 70 of FIG. 2, the displacement of the lance 30 is relatively low and constant. Before the wire tabbing 42 is inserted into the poke-in contact 10, the contact beam 50 is not in contact with the base 51 of the poke-in contact 10 (See FIG. 1D). As the wire tabbing is inserted into the lance 30, the front end 58 of the lance 30 moves inwardly and downwardly toward the contact beam 50. The lance 30 displaces downward as the wire tabbing is inserted until the contact beam 50 touches the base 51 of the poke-in contact 10. The displacement downwardly is limited by the base 51 and causes the end 58 to exert a force against the tabbing 42. As shown at point 76 in FIG. 2, the reaction force and displacement increases as more force is applied to insert the wire tabbing 42 into the poke-in contact 10. Once the contact beam 50 is in full contact with the base 51 of the poke-in contact 10, the front end 58 of the lance 30 begins to compress and displace as the contact beam 50 and back section 56 do not displace any further. The maximum force and displacement the lance 30 can endure without breaking is shown at point 74 in FIG. 2 which is the course related to the ultimate tensile strength (UTS) of the material selected. It is preferred to maintain displacement that is less than the UTS to prevent deformation of the lance and the contact. The lance 30 will remain at the maximum displacement (shown by point 74) until the protrusions 40 of the lance 30 are released, and the wire tabbing 42 is removed. Section 72 in FIG. 2 shows the reduction in displacement and reaction force as the wire tabbing 42 is removed from the lance 30.

Figure 3:
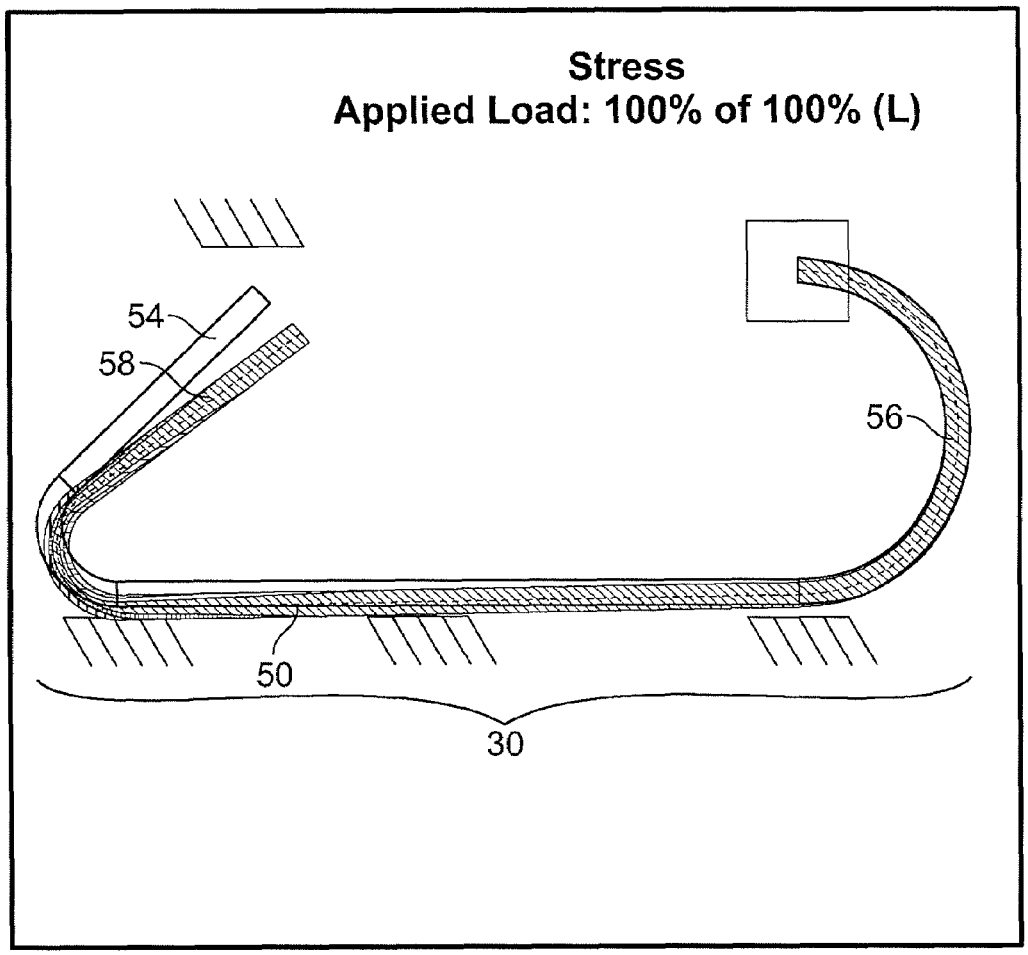
FIG. 3 is a graphical analysis of the stress upon the contact of the present invention.

FIG. 3 illustrates the stresses on the locking lance 30 during insertion of the wire tabbing 42. The analysis was taken during insertion of a wire tabbing (not shown) where the maximum stress is applied to the lance 30. In the uncompressed position, when the contact 10 is not receiving wire tabbing, and no stresses are placed on the lance 30 and the contact beam 50 is not in contact with the base 51 of the contact 10. Only when the wire tabbing 42 is inserted into the lance 30 do sufficient stresses begin to occur to move the contact beam 50 into contact with the base 51 in a terminal connection. The back section 56 of the lance 30 does not sustain any stresses, as the normal force of the wire tabbing is inserted into the lance 30 is resolved as a vertical force and is applied in the front section 58 of the lance 30 closest to the wire tabbing 42 and in the area of the lance 30 that is flexing the most. The normal force of the wire tabbing 42 being inserted into the contact 10 by pushing down on the lance 30 results in stresses at the front side 58 of the lance 10 and pushes the contact beam 50 downward to make a terminal connection to the base 51 below.

The poke-in contact assembly provides a secure connection for wire tabbing that does not require the use of tools or other utensils when inserting. The lance of the poke-in contact displaces upon insertion of the wire tabbing and absorbs the majority of the force applied by the tabbing, thereby reducing the amount of force applied to the printed circuit board or other device the contact is mounted to. In addition, the poke-in contact applies a force or retention when the tabbing is forced outward from the poke-in contact without the use of tools or other utensils. To effectively remove the tabbing from the contact, a tool or utensil is used to depress the lance and release the tabbing and the force applied to the tabbing by the lance.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A connector assembly for receiving an electrical component comprising:

a base;

a plurality of pin tails, each pin tail of the plurality of pin tails extending in a substantially perpendicular direction away from the base and configured to connect to a printed circuit board;

a plurality of walls, each wall of the plurality of walls extending from the base in an opposed direction of the plurality of pin tails;

a top disposed to extend between the plurality of walls and substantially parallel to the base;

a lance, the lance being disposed to extend from the top and further comprising:

an arcuate back end;

a contact beam that extends parallel to the base;

a front section disposed at a preselected angle to the contact beam;

at least one protrusion extending from the front section; and wherein the electrical component is manually inserted into the connector assembly with an insertion force, pressing against the front section, which moves upon insertion of the electrical component, wherein upon displacement, the contact beam touches the base to complete an electrically conductive connection, and wherein the electrical component is secured in the connector until a force is applied to the at least one protrusion extending from the front section.

2. The connector assembly of claim 1 wherein the electrical component is manually inserted into the connector assembly without the aid of an additional device.

3. The connector assembly of claim 1 wherein the lance exerts an equal and opposite reactive force upon the electrical component to secure the electrical component in the connector assembly.

4. The connector assembly of claim 1 wherein at least one pin tail of the plurality of pin tails is connected to the printed circuit board by a weld connection.

5. The connector assembly of claim 1 wherein the electrical component is releasable by the force applied to the at least one protrusion using a tool or utensil.

6. The connector assembly of claim 1 wherein the contact beam substantially absorbs the insertion force of the electrical component.

7. A poke-in contact assembly comprising:

a base;

a plurality of pin tails, each pin tail of the plurality of pin tails extending in a substantially perpendicular direction away from the base and secured to a printed circuit board;

a plurality of walls, each wall of the plurality of walls extending from the base in an opposed direction of the plurality of pin tails;

a top disposed to extend between the plurality of walls and substantially parallel to the base;

a lance, the lance being disposed to extend from the top and further comprising:

an arcuate back end;

a contact beam that extends parallel to the base;

a front section disposed at a preselected angle to the contact beam;

at least one protrusion extending from the front section; and wherein an electrical component is manually inserted into the connector assembly, pressing against the front section, which moves upon insertion of the electrical component, wherein upon displacement, the contact beam touches the base to complete an electrically conductive connection, wherein the lance exerts an equal and opposite reactive force upon the electrical component to secure the electrical component in the connector assembly and wherein the electrical component is secured in the connector until a force is applied to the at least one protrusion extending from the front section.

8. The connector assembly of claim 7 wherein the protrusion is manually inserted into the connector assembly without the aid of an additional device.

9. The connector assembly of claim 7 wherein the electrical component is releasable by a force applied to the at least one protrusion thereby releasing the equal and opposite reactive force upon the electrical component.

10. The connector assembly of claim 7 wherein at least one pin tail of the plurality of pin tails is connected to the printed circuit board by a weld connection.

11. The connector assembly of claim 9 wherein the force applied to the at least one protrusion is applied with the use of a tool or utensil.

12. The connector assembly of claim 7 wherein the contact beam substantially absorbs the insertion force of the electrical component.

* * * * *